US006171171B1

(12) United States Patent
Barthold

(10) Patent No.: US 6,171,171 B1
(45) Date of Patent: *Jan. 9, 2001

(54) TOY VEHICLE HAVING LIGHT CONDUCTIVE BODY

(75) Inventor: Mark Barthold, Redondo Beach, CA (US)

(73) Assignee: Mattel, Inc., El Segundo ( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/132,130

(22) Filed: Aug. 10, 1998

(51) Int. Cl.[7] ..... A63H 17/28
(52) U.S. Cl. ..... 446/438; 446/219
(58) Field of Search ..... 446/22, 23, 219, 446/438, 439, 477, 485

(56) References Cited

U.S. PATENT DOCUMENTS

| | | | | |
|---|---|---|---|---|
| 1,938,129 | * | 12/1933 | Arnold | 446/23 |
| 2,610,442 | * | 9/1952 | Bonanno | 446/428 |
| 2,883,796 | * | 4/1959 | Reveka | 446/219 |
| 3,594,949 | * | 7/1971 | Tam | 446/438 |
| 4,200,287 | | 4/1980 | Ryan et al. . | |
| 4,247,107 | | 1/1981 | Smith, III et al. . | |
| 4,559,022 | | 12/1985 | Herstein et al. | 446/438 |
| 4,813,905 | * | 3/1989 | Yamaguchi et al. | 446/438 |
| 4,865,575 | | 9/1989 | Rosenthal | 446/175 |
| 4,938,730 | * | 7/1990 | Yamane et al. | 446/477 |
| 5,085,148 | | 2/1992 | Konno | 104/130 |
| 5,145,439 | * | 9/1992 | Wagener | 446/219 |
| 5,297,484 | | 3/1994 | Piserchia et al. | 105/1.5 |
| 5,352,147 | * | 10/1994 | Nagel et al. | 446/439 |
| 5,507,679 | | 4/1996 | Getsay | 446/444 |
| 5,542,668 | | 8/1996 | Casale | 463/59 |
| 5,562,522 | | 10/1996 | Richno | 446/444 |
| 5,567,032 | | 10/1996 | Heizmann | 362/37 |
| 5,637,996 | | 6/1997 | McDarren et al. | 324/178 |
| 5,709,453 | | 1/1998 | Krent et al. | 362/80 |

FOREIGN PATENT DOCUMENTS

| | | | | |
|---|---|---|---|---|
| 690617 | * | 6/1965 | (IT) | 446/439 |
| WO 97/04989 | | 2/1997 | (WO) . | |

* cited by examiner

*Primary Examiner*—Jacob K. Ackun
*Assistant Examiner*—Jeffrey D. Carlson
(74) *Attorney, Agent, or Firm*—Roy A. Ekstrand

(57) ABSTRACT

A substantially solid light conductive toy vehicle body is fabricated to include a light cavity in which a light emitting diode is supported. A vehicle drive mechanism is operatively coupled to a pair of charging terminals and a power storage capacitor. The light emitting diode is energized when the power supply capacitor is charged to permeate light into the solid light transmissive body of the toy vehicle. The outer surface of the toy vehicle body is light transmissive and is coated, for the most part, by an opaque coating. A plurality of light transmissive openings are formed in the opaque coating to allow selectively determined points of light to permeate light from the vehicle body.

1 Claim, 2 Drawing Sheets

TOY VEHICLE HAVING LIGHT CONDUCTIVE BODY

FIELD OF THE INVENTION

This invention relates generally to toy vehicles and particularly to those utilizing light energy as part of an amusement or play pattern.

BACKGROUND OF THE INVENTION

Toy vehicles of the type used with track sets are well known in the arts and have been provided in a virtually endless variety. Such vehicles are either unpowered in which case the track set typically provides a launcher or booster to impart sufficient energy to the toy vehicles to traverse the track. Alternatively, self-powered toy vehicles are often used in combination with toy vehicle track sets. originally, such self-powered toy vehicles derived their energy from spring driven windup apparatus or inertial motor apparatus. In the former, a spring is wound to provide energy for driving the toy vehicle, while in the latter, the toy vehicle must be rapidly rolled across a surface to store energy within a rotating flywheel. For many years, the steady emergence of relatively low cost self-powered vehicles has indicated that the modern motor and battery driven combination is likely to pervade the toy vehicle market. A variation on the electrically powered toy vehicles has been developed in recent years in which the battery is replaced by a large capacitor. The overall operation is the same as a motor battery combination with the difference being found in the rapid charge which may be applied to a capacitor. Such capacitors, however, do discharge more quickly and hold less energy when charged than a battery. Nonetheless, both systems are readily capable of providing exciting, amusing, and entertaining rechargeable toy vehicles.

Many other improvements in toy vehicles and the track sets used therewith make use of varied lighted features. For example, International Publication No. WO97/04989 filed by McGaffigan sets forth a VEHICLE TRACK LIGHTING SYSTEM having a toy vehicle supported upon and guided through a vehicle trackway. A light producing device such as an LED is supported within the toy vehicle and directed to radiate light energy downwardly upon the track. The track is preferably formed of a light transmissive material allowing the track to receive much of the energy from the light emitting diode and to couple it outwardly to radiate from the track about the vehicle.

U.S. Pat. No. 4,559,022 issued to Herstein et al sets forth a TOY VEHICLE WITH SIMULATED HEADLIGHTS having a toy vehicle supporting a light guide within which an incandescent bulb is supported. The light guide is coupled to a plurality of dashboard outlets within the cockpit of the vehicle and two headlights at the vehicle front. The light within the light guide is variously reflected and directed to couple the light from the bulb outwardly through the dashboard elements and the headlights.

U.S. Pat. No. 5,567,032 issued to Heizmann sets forth an ILLUMINATING DEVICE FOR VEHICLES having a generating unit and a light distributing unit utilizing fiber optic fibers coupling the light generating unit to the light using units.

U.S. Pat. No. 5,709,453 issued to Krent et al sets forth a VEHICLE LIGHTING HAVING REMOTE LIGHT SOURCE which utilizes light conducting fluorescent substance containing sheets of material. An exposed edge of the sheet material is used to provide intense illuminated strips of light where desired upon the vehicle. The vehicle is operative in either natural light or a dedicated light source used to illuminate a light gathering portion of the sheet material.

U.S. Pat. No. 5,637,999 issued to McDarren et al sets forth a TOY SYSTEM WITH MOVABLE VEHICLES having a speed measuring and voice reporting system. The system measures the speed of a toy car and reports the speed contemporaneously in audible speech. The system employs optical detectors and timing circuitry to compute the speed and a voice synthesizer to sound the speed values.

U.S. Pat. No. 4,865,575 issued to Rosenthal sets forth a LIGHT RESPONSIVE REMOTE CONTROL VEHICLE having a pair of different wavelength light sensors on the outer portion thereof. Within the toy vehicle, light separation is translated to control inputs. A pistol-like control unit produces a controlling light beam which is used to illuminate the sensors of the toy vehicle to control its travel.

U.S. Pat. No. 4,200,287 issued to Ryan et al sets forth a REMOTELY CONTROLLED MINIATURE VEHICLE operative in a slot car toy trackway having designated lanes of travel about the track for a plurality of vehicles.

U.S. Pat. No. 4,247,107 issued to Smith, III et al sets forth an ELECTRONICALLY CONTROLLED ROADRACE SYSTEM WITH SOUND GENERATOR for providing a variety of audible signals during operation.

U.S. Pat. No. 5,085,141 issued to conno sets forth a TOY WITH REMOTE CONTROL TRACK SWITCHING having an infrared transmitter for transmitting at least one type of infrared signal together with a track having at least one lane changeover element for switching between track portions. The infrared signal is received by the changeover and thereby controls the travel path of the toy vehicle.

U.S. Pat. No. 5,297,484 issued to Piserchia et al sets forth a VEHICLE GUIDANCE TRACK SYSTEM for electric toy vehicles which includes one or more grooves formed within a dielectric material. The wheels of the vehicle fit within the grooves and are configured to accept the wheels of self-powered and unpowered cars.

U.S. Pat. No. 5,507,679 issued to Getsay sets forth a TOY VEHICLE SYSTEM AND ASSOCIATED VEHICLE having a resiliently biased driven wheel. The wheel is driven by a motor and interposed gears for rotating the driven wheel. The driven wheel is in contact with a lateral side of the track to propel the toy vehicle.

U.S. Pat. No. 5,542,668 issued to Casale et al sets forth a GAME USING SLOT TRACK RACEWAY having two side-by-side slots for enabling two racing cars to run a closed loop track. Individual lap counters associated with each lane are provided.

U.S. Pat. No. 5,562,522 issued to Richno sets forth a LINE GUIDED SELF-PROPELLED VEHICLE having a body replicating a dragster. Within the body, a rubberband windup mechanism is operatively coupled to the rear drive wheels of the vehicle. When the rubberband is wound and the vehicle is placed on an operating surface, release of the vehicle allows the stored energy in the rubberband to accelerate the vehicle for a brief interval until the energy has been expended.

While the foregoing described prior art devices have improved the art, and in some instances enjoyed commercial success, there remains nonetheless a continuing need in the art for evermore improved, interesting, and exciting toy vehicles.

SUMMARY OF THE INVENTION

Accordingly, it is a general object of the present invention to provide an improved toy vehicle. It is a more particular object of the present invention to provide an improved toy vehicle which effectively utilizes light energy as a part of the play pattern and which adds realism to the vehicle.

In accordance with the present invention, there is provided a toy vehicle comprising: a vehicle body formed of a light conductive material and defining an outer surface and an interior cavity, an opaque coating substantially covering the outer surface and defining a plurality of light transmissive openings therein, and light producing means supported within the cavity for illuminating the vehicle body, the illumination of the body and the opaque coating cooperating to allow light conducted from the cavity through the body to emanate outwardly through the openings but not through the opaque coating.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, and in which:

DESCRIPTION OF THE PREFERRED EMBODIMENT

Figure 1:
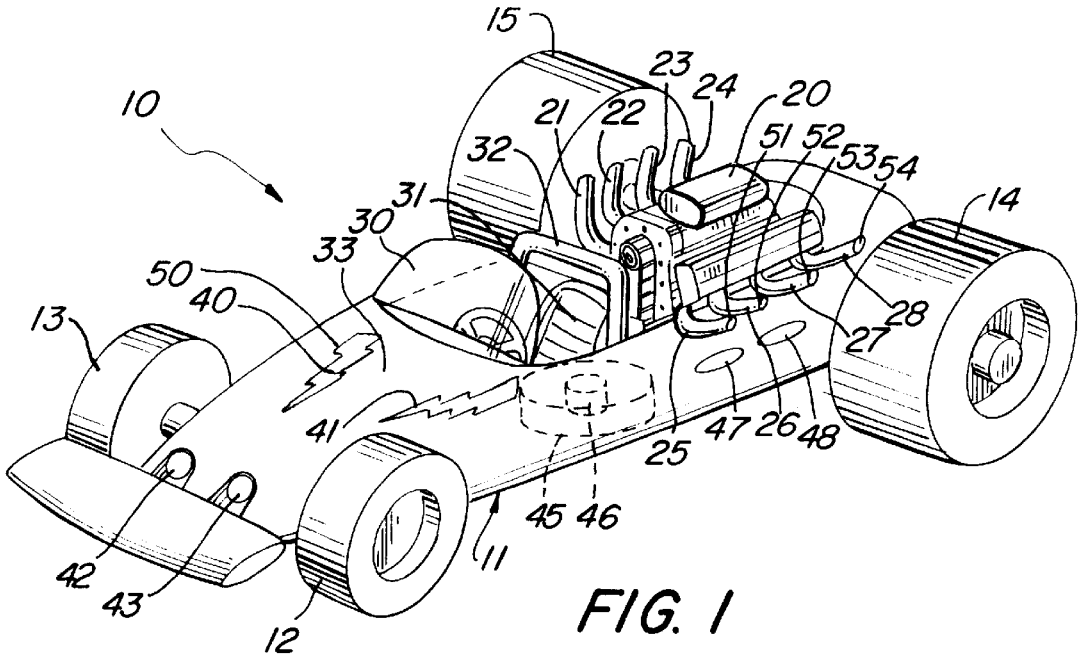
FIG. 1 sets forth a perspective view of a toy vehicle constructed in accordance with the present invention.

FIG. 1 sets forth a perspective view of a toy vehicle constructed in accordance with the present invention and generally referenced by numeral 10. Toy vehicle 10 is fabricated to generally resemble a racing vehicle. However, it will be apparent to those skilled in the art that the present invention toy vehicle may be fabricated in a variety of appearances utilizing the principles of the present invention and therefore not departing therefrom. Toy vehicle 10 includes a body 11 having an opaque coating 50 covering the majority of body 11 with the exception of the various light transmissive openings formed in opaque coating 50. For example, light transmissive openings 40 and 41 formed in nose 33 of body 11. For further example, light transmissive openings 42 and 43 simulating driving lights at the front of body 11. Additional light transmissive openings are supported near the rear wheel showing light transmissive openings 47 and 48. Finally, a simulated engine 20 preferably formed as an integral member of body 11, supports a plurality of outwardly extending header pipes 25, 26, 27, and 28 on one side of simulated engine 20, each of which defines a light transmissive end 51, 52, 53, and 54, respectively. Simulated engine 20 further includes a mirror image set of header pipes 21, 22, 23, and 24. In the perspective shown, the light transmissive ends of header pipes 21 through 24 is not seen. However, it will be understood that pipes 21 through 24 area identical in operation and fabrication and are made in a mirror image of pipes 25 through 28. In further accordance with the present invention, a cavity 45 is formed within body 11 and supports a light emitting diode 46. As is better seen in FIG. 3, a capacitor powered electric motor driven power system is supported within body 11 and is operatively coupled to light emitting diode 66 to form the circuit shown in FIG. 2.

The configuration of light emitting diode 66 together with the drive apparatus of toy 10 is set forth below in FIGS. 2 and 3 in greater detail. However, suffice it to note here that light emitting diode 46 is energized whenever capacitor 63 (seen in FIGS. 2 and 3) is energized by the charging system. Thus in further accordance with the present invention, the light output of light emitting diode 46 is directed inwardly to the interior of body 11. In accordance with the present invention and in its preferred form, body 11 is fabricated of a relatively solid piece of light transmissive material. Also, in further accordance with the present invention, opaque coating is sufficiently opaqued to prevent light from permeating outwardly from the outer surface of body 11. Except for the above-mentioned openings or their equivalent, the remainder of body 11 is preferably coated with an opaque coating 50 which may be provided by a thin plastic stretchable adhesive member, a plurality of interlocking decals or labels, or a light opaque coating of paint as the user desires. The essential function of opaque coating 50 is to cover the bulk of body 11 and prevent light permeation outwardly from the body surface in response to light emitting diode 46 while the various openings in opaque coating 50 allows selected areas to be illuminated.

Thus, in the illustration presented by toy vehicle 10 in FIG. 1, the light output of light emitting diode 46 is conducted throughout light transmissive body 11, but is only able to permeate outwardly through light transmissive openings 40, 41, 42, 43, 47, 48, and 51 through 54 together with the corresponding light transmissive openings formed in the ends of headers 21 through 24. As a result, a single light emitting diode is capable of providing a variety of exciting lighting features during the operation of toy vehicle 10.

Figure 2:
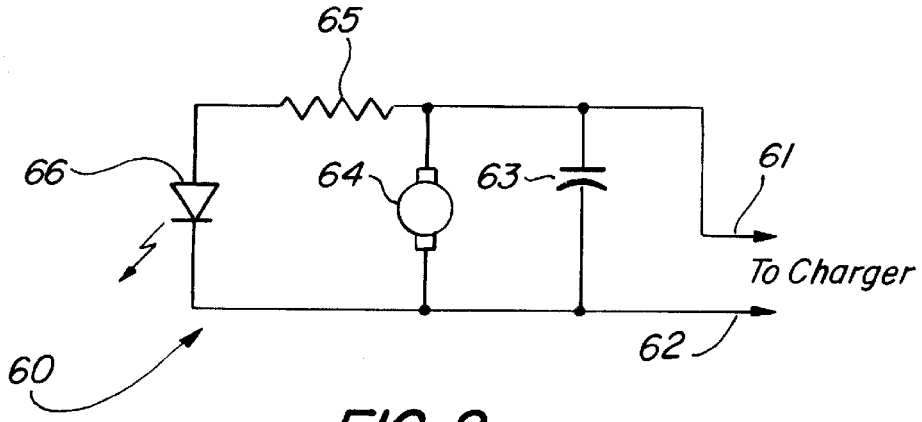
FIG. 2 sets forth a schematic diagram of the electrical system within the present invention toy vehicle.

FIG. 2 sets forth the electrical system which propels and illuminates toy vehicle 10. The combination of motor 64 in parallel with capacitor 63 and a pair of charging terminals 61 and 62 forms a well known vehicle drive system which has recently emerged in toy vehicles. In this system, capacitor 63 is substituted for a conventional rechargeable battery. Thus when a DC voltage is applied between terminals 61 and 62, capacitor 63 charges up and motor 64 begins to run. When connection is severed from the charger, the energy within capacitor 63 then passes through motor 64 continuing to power motor 64 apart from the charging mechanism. This aspect of power system 60 is entirely conventional. In accordance with the present invention, a resistor 65 and a light emitting diode 66 are coupled as a series pair across motor 64. Thus when terminals 61 and 62 are coupled to a DC charging source, capacitor 63 begins to charge and motor 64 begins to run. Concurrently, and in accordance with the present invention, current also flows through resistor 65 and light emitting diode 66 to produce the above-described illumination of the present invention toy vehicle. Once capacitor 63 has fully discharged, motor 64 ceases operation and light emitting diode 66 ceases the output of light energy. In the toy vehicle described above in FIG. 1, this translates to initial illumination within the various light transmissive openings in opaque coating 50 as the charger is operative and as the vehicle runs discharging its capacitor. As the capacitor discharges, the speed of the vehicle decreases and the light output of light emitting diode 46 correspondingly decreases.

Figure 3:
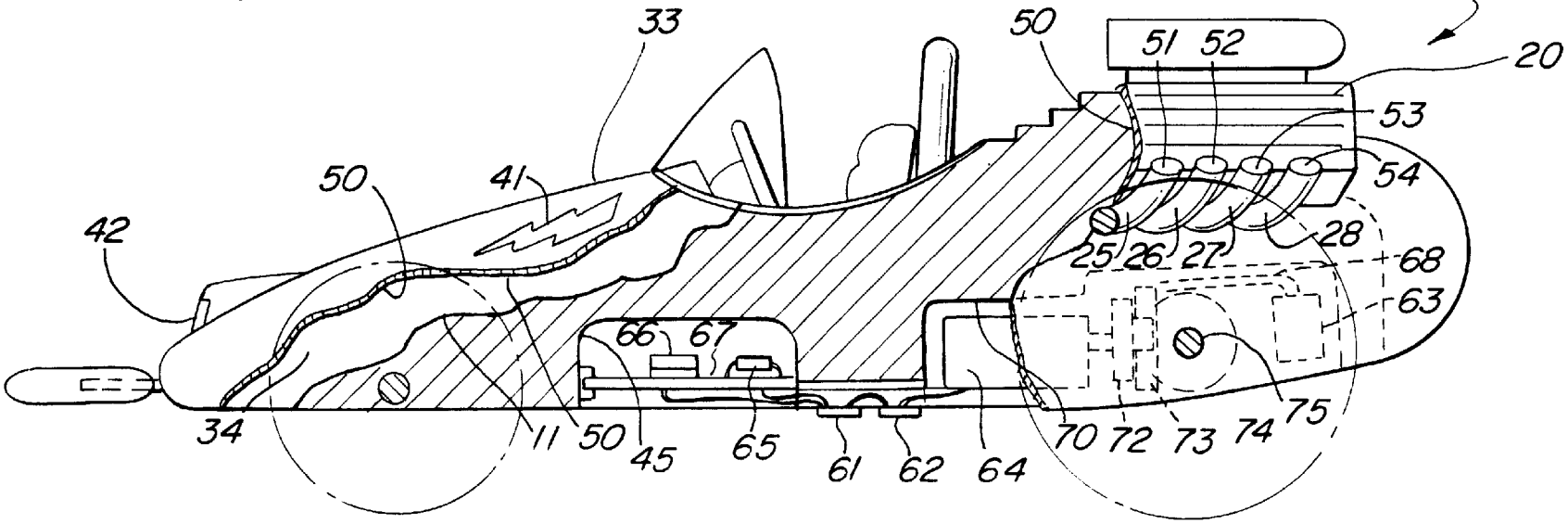
FIG. 3 sets forth a partially sectioned side view of a toy vehicle constructed in accordance with the present invention.

FIG. 3 sets forth a partially sectioned side elevation view of toy vehicle 10. As described above, toy vehicle 10 includes a substantially solid toy vehicle body 11 having a light transmissive outer surface 34. As is also described above, the majority of light transmissive outer surface 34 is covered by an opaque coating 50 having a plurality of openings such as openings 41 and 42 in nose portion 33 of body 11 as well as end openings 51, 52, 53, and 54 formed in the end portions of header pipes 25, 26, 27, and 28, respectively.

In further accordance with the present invention, body 11 which is, as mentioned above, substantially formed of a solid block of light transmissive material, defines a cavity 45 and a motor cavity 70 at the lower portion of body 11. cavity 45 receives a printed circuit board supporting a light emitting diode 66 and a current limiting resistor 65. Also supported upon body 11 from the underside are contacts 61 and 62 which in accordance with conventional fabrication techniques, are couplable to an external DC power source for charging (not shown). Within motor cavity 70, a motor 64 is supported and is coupled to a gear 74 supported upon an axle 75 through gears 72 and 73. In further accordance with the electrical system shown in FIG. 2, a capacitor 63 is supported within cavity 70 and is operably coupled to terminals 61 and 62 by a plurality of connecting wires 68.

In operation, toy vehicle 10 is positioned to place contacts 61 and 62 to contact with an external DC power supply (not shown). The DC power applied to terminals 61 and 62 is operable in accordance with the circuit shown in FIG. 2 to simultaneously charge capacitor 63, run motor 64, and energize light emitting diode 66. Once capacitor 63 has been charged, vehicle 10 is released and motor 64 continues to drive axle 75 propelling the toy vehicle while light emitting diode 66 continues to illuminate vehicle body 11. In accordance with the invention, the use of an entire body for toy vehicle 10 fabricated of a light transmissive material causes body 11 in its entirety to be illuminated with light which, but for opaque coating 50 covering light transmissive outer surface 34 of body 11, would cause the entire body to glow and permeate light outwardly. In the present invention scheme, however, opaque coating 50 is used to limit the light output to openings provided within the opaque coating. This in turn allows significant advantage in determining where the best light output is to take place for maximum amusement and entertaining. One particularly apt place to allow light output is in the end portions of the header pipes of simulated engine 20. Thus in FIG. 3, ends 51 through 54 of header pipes 25 through 28 are optimum light output openings. In accordance with an important aspect of the present invention, it should be noted that fabricating virtually all of body 11 of a single piece of light transmissive material provides substantial cost reduction and ease of manufacture when compared to the prior art systems which utilize various conductive light pipe type guides emanating outwardly from a light source to the output ends of the light pipes. The fabrication of the present invention toy is substantially the same as other similarly complex toy vehicles but readily lends itself to mass production, high speed molding processes. As mentioned above, opaque coating 50 may comprise a layer of opaque paint having suitable openings formed therein or may alternatively be provided by a self-adhesive label, decal, tape area, or other means for rendering outer surface 34 opaque.

Figure 4:
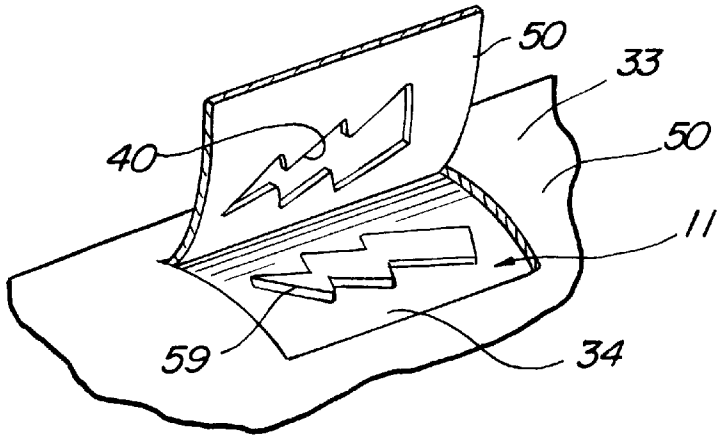
FIG. 4 sets forth a partial section view illustrating the opaque coating and light transmissive openings utilized in the present invention toy vehicle.

FIG. 4 sets forth a partial view illustrating the relationship between light transmissive body 11, opaque coating 50, and light transmissive opening 41. For purposes of illustration, surface 34 of body 11 is shown revealed by a curled up portion of opaque coating 50. Thus in the example shown in FIG. 4, opaque coating 50 may comprise a self-adhesive plastic layer, a decal, for opaque paint coating. The important aspect, with respect to the present invention, is the formation of a raised member 59 upon surface 34 of body 11. Raised member 59 is received within opening 40 due to its similar shape and placement. Of importance connected with raised member 59 is the enhanced capability of providing light output from body 11 which is sufficient to fully illuminate opening 40. In some instances, the use of a raised member such as member 59 within an opening such as opening 40 improves the light output from the opening.

What has been shown is a toy vehicle having a light conductive body formed as a single unit and housing a light emitting diode illumination source. The substantially solid light transmissive material body is covered, for the most part, with an opaque coating having a plurality of light transmissive openings therein which permit selective light output from body 11 in response to the diode illumination. The vehicle shown is readily fabricated of molded plastic components in mass production high volume fabrication.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy vehicle having electric motor drive means, said toy vehicle comprising:

a substantially solid vehicle body formed of a light conductive material and defining an outer surface and an interior cavity;

an opaque coating substantially covering said outer surface and defining a plurality of light transmissive openings therein;

a simulated vehicle engine having a plurality of outwardly extending simulated header pipes formed of a light conductive material each defining an outer end, said simulated header pipes being in light communication with said vehicle body; and light producing means having a light emitting diode for imparting light into said vehicle body supported within said cavity separated from said openings, said imparted light illuminating substantially all of said vehicle body and said simulated header pipes, said illumination of said body and said opaque coating cooperating to allow light conducted from said cavity throughout said body to emanate outwardly through said openings and said outer ends of said simulated header pipes but not through said opaque coating whereby said simulated engine appears to be exhausting hot gases through said simulated header pipes.

* * * * *